US008345897B2

(12) United States Patent
Takahashi et al.

(10) Patent No.: US 8,345,897 B2
(45) Date of Patent: Jan. 1, 2013

(54) ELECTROMAGNETIC CONVERSION UNIT

(75) Inventors: Masanori Takahashi, Chiyoda-ku (JP); Kiyofumi Mori, Chiyoda-ku (JP)

(73) Assignee: Mitsubishi Electric Engineering Co., Ltd, Tokyo (JP)

( * ) Notice: Subject to any disclaimer, the term of this patent is extended or adjusted under 35 U.S.C. 154(b) by 325 days.

(21) Appl. No.: 12/812,529

(22) PCT Filed: Mar. 31, 2008

(86) PCT No.: PCT/JP2008/000825

§ 371 (c)(1),
(2), (4) Date: Jul. 12, 2010

(87) PCT Pub. No.: WO2009/122459

PCT Pub. Date: Oct. 8, 2009

(65) Prior Publication Data

US 2010/0283567 A1 Nov. 11, 2010

(51) Int. Cl.
*H04R 25/00* (2006.01)

(52) U.S. Cl. ..... 381/176; 381/399; 381/162; 381/431

(58) Field of Classification Search ..... 381/162, 381/176, 399, 431

See application file for complete search history.

(56) References Cited

U.S. PATENT DOCUMENTS

| | | | | |
|---|---|---|---|---|
| 5,003,609 | A * | 3/1991 | Muraoka | 381/408 |
| 6,760,462 | B1 * | 7/2004 | Thigpen | 381/431 |
| 6,934,402 | B2 * | 8/2005 | Croft et al. | 381/412 |
| 6,956,953 | B2 * | 10/2005 | Mazarakis | 381/152 |
| 7,116,796 | B1 * | 10/2006 | Reenberg | 381/431 |
| 7,142,688 | B2 * | 11/2006 | Croft et al. | 381/431 |
| 7,146,017 | B2 * | 12/2006 | Steere et al. | 381/176 |
| 7,146,019 | B2 * | 12/2006 | Levitsky | 381/399 |
| 7,174,024 | B1 * | 2/2007 | Suzuki et al. | 381/152 |
| 7,181,041 | B2 * | 2/2007 | Koike | 381/401 |
| 7,251,342 | B2 * | 7/2007 | Graebener | 381/431 |
| 7,286,681 | B2 * | 10/2007 | Gerkinsmeyer | 381/430 |
| 7,333,620 | B2 * | 2/2008 | Nguyen et al. | 381/152 |
| 7,412,065 | B2 * | 8/2008 | Nguyen et al. | 381/152 |
| 7,450,729 | B2 * | 11/2008 | Nguyen et al. | 381/152 |
| 7,912,239 | B2 * | 3/2011 | Nishimura et al. | 381/396 |
| 7,912,241 | B1 * | 3/2011 | Graber | 381/431 |
| 8,085,969 | B2 * | 12/2011 | Simidian et al. | 381/399 |

(Continued)

FOREIGN PATENT DOCUMENTS

JP 52-113717 A 9/1977

(Continued)

*Primary Examiner* — David S. Warren

(74) *Attorney, Agent, or Firm* — Sughrue Mion, PLLC

(57) ABSTRACT

There is provided: first to fourth magnetic pole yokes 13-16 magnetized by the magnets 11, 12 having both poles on these opposite faces to establish a magnetic pole; and a vibrating membrane 17 disposed between the magnets 11, 12 and electromagnetically coupled to the yokes 13-16 by energizing a meandering coil pattern **17*b* thereon to vibrate in a predetermined direction. The yokes 13-16 include: abutting sections 13*a*-16*a* to be magnetized with abutting against the magnets 11, 12, and magnetic pole sections 13*b*-16*b* establishing the magnetic pole in a band shape. The sections 13*b*-16*b* each are disposed on the upper and lower sides of the vibrating membrane 17, and disposed with a gap (sound emitting hole 19) such that the magnetic poles different in magnetic polarity are positioned alternately in the lateral direction of the membrane 17** to form magnetic pole faces on the upper and lower sides thereof.

4 Claims, 4 Drawing Sheets

U.S. PATENT DOCUMENTS

2002/0057822 A1* 5/2002 Kermani et al. ..... 381/427
2002/0118856 A1* 8/2002 Croft et al. ..... 381/412
2003/0068054 A1* 4/2003 Sotme et al. ..... 381/152
2003/0228029 A1* 12/2003 Graebener ..... 381/432
2004/0047488 A1* 3/2004 Levitsky ..... 381/399
2005/0031153 A1* 2/2005 Nguyen et al. ..... 381/414
2005/0036648 A1* 2/2005 Nguyen et al. ..... 381/424
2006/0023902 A1* 2/2006 Thigpen ..... 381/176
2006/0050923 A1* 3/2006 Croft et al. ..... 381/421
2006/0078135 A1* 4/2006 Royer et al. ..... 381/176
2006/0291688 A1* 12/2006 Nishimura et al. ..... 381/396
2007/0076915 A1* 4/2007 Shin et al. ..... 381/400
2007/0098207 A1* 5/2007 Lin ..... 381/399
2007/0127767 A1* 6/2007 Croft et al. ..... 381/422
2007/0263894 A1* 11/2007 Stiles ..... 381/335
2008/0019558 A1* 1/2008 Simidian et al. ..... 381/408
2008/0101648 A1* 5/2008 Hatanaka et al. ..... 381/412
2008/0219469 A1* 9/2008 Simidian et al. ..... 381/92
2009/0097693 A1* 4/2009 Croft et al. ..... 381/399
2010/0283567 A1* 11/2010 Takahashi et al. ..... 335/296
2011/0293121 A1* 12/2011 Yan ..... 381/191
2011/0311090 A1* 12/2011 Nagumo et al. ..... 381/398
2011/0311091 A1* 12/2011 Nagumo et al. ..... 381/398
2012/0087518 A1* 4/2012 Simidian et al. ..... 381/120
2012/0170791 A1* 7/2012 Meng ..... 381/386
2012/0177246 A1* 7/2012 Shi et al. ..... 381/398

FOREIGN PATENT DOCUMENTS

JP 09-331596 A 12/1997

* cited by examiner

ELECTROMAGNETIC CONVERSION UNIT

TECHNICAL FIELD

The present invention relates to an electromagnetic conversion unit including a coil pattern on the surface of a vibrating membrane to reproduce a sound from an audio signal.

BACKGROUND ART

At present, a variety of technologies are suggested about an electromagnetic conversion unit where a permanent magnet and a vibrating membrane are combined. For example, an electromagnetic conversion unit described in Patent Document 1 includes a permanent magnet board, a vibrating membrane disposed at a position opposed to the permanent magnet board, and a buffer member interposed between the permanent magnet board and the vibrating membrane. In the permanent magnet board, belt-like magnetic poles different from each other in magnetic polarity are formed alternately at a certain spacing. Further, in the vibrating membrane, a coil with a meandering conductor pattern is formed at a position opposed to a so-called "neutral zone of magnetization" that is a gap between the magnetic poles different from each other in magnetic polarity.

By those arrangement, when a current (audio signal) flows through the coil of the vibrating membrane, the coil and the multipole magnetized pattern of the permanent magnet board are electromagnetically coupled to each other to generate audio vibration in the vibrating membrane according to Fleming's rule. Further, the permanent magnet board, the vibrating membrane, and a buffer member are enclosed by a metallic frame to be attached to a speaker casing, and the sound wave generated by the vibration is emitted through an emitting hole provided through the permanent magnet board and the metallic frame to reproduce audio data.

Patent Document 1: JP-A-09-331596 (JP-A-1997-331596)

The conventional electromagnetic conversion unit is arranged as described above, and thus it is necessary to further provide a permanent magnet board at a position opposed to the vibrating membrane so as to hold the vibrating membrane from two directions by sandwiching the membrane between the permanent magnet boards. There is a problem that, when the thickness of the permanent magnet board is increased, the total thickness of the electromagnetic conversion unit increases, which can make it impossible to be built in a thin electronic apparatus. Therefore, it is required to use a magnet having a high maximum energy product (BHmax) such as a neodymium iron boron magnet in order to obtain a magnetic flux density required for driving the vibrating membrane without increasing the thickness of the permanent magnet board. Thus, there is a problem that the cost of the magnetic circuit can be boosted.

The present invention has been made to solve the above-mentioned problems, and an object of the present invention is to provide an electromagnetic conversion unit capable of obtaining a magnetic flux density necessary for driving a vibrating membrane without increasing the total thickness of the electromagnetic conversion unit even when the magnetic circuit is built with a magnet having a low maximum energy product.

DISCLOSURE OF THE INVENTION

The electromagnetic conversion unit according to the present invention has magnets disposed at both the ends of the conversion unit, and includes a plurality of magnetic pole yokes that are each magnetized by the magnet to establish a magnetic pole; and a vibrating membrane that is disposed between the magnetic pole yokes and is electromagnetically coupled to the magnetic pole yokes by energizing a coil pattern formed on the surface of the membrane to vibrate in a predetermined direction, wherein the magnetic pole yokes each include an abutting section that abuts against the magnet to be magnetized and a magnetic pole section for establishing the magnetic pole in a band or strip shape, and wherein a plurality of magnetic pole sections of the plural magnetic pole yokes are disposed on the upper and lower sides of the vibrating membrane, and also the magnetic pole sections are disposed at a spacing such that the magnetic pole sections different from each other in magnetic polarity are positioned alternately in a lateral direction of the vibrating membrane to form magnetic pole faces on the upper and lower sides of the vibrating membrane.

According to the present invention, the electromagnetic conversion unit is arranged to have magnets disposed at both the ends of the conversion unit, and include a plurality of magnetic pole yokes that are each magnetized by the magnet to establish a magnetic pole; and a vibrating membrane that is disposed between the magnetic pole yokes and is electromagnetically coupled to the magnetic pole yokes by energizing a coil pattern formed on the surface of the membrane to vibrate in a predetermined direction, wherein the magnetic pole yokes each include an abutting section that abuts against the magnet to be magnetized and a magnetic pole section for establishing the magnetic pole in a band shape, and wherein a plurality of magnetic pole sections of the plural magnetic pole yokes are disposed on the upper and lower sides of the vibrating membrane, and also the magnetic pole sections are disposed at a spacing such that the magnetic pole sections different from each other in magnetic polarity are positioned alternately in a lateral direction of the vibrating membrane to form magnetic pole faces on the upper and lower sides of the vibrating membrane. Thus, the magnet can be changed in size and thickness without increasing the total thickness of the electromagnetic conversion unit. Therefore, a necessary magnetic flux density can be provided even when the magnetic circuit is built with an inexpensive magnet having a low maximum energy product.

BEST MODE FOR CARRYING OUT THE INVENTION

Embodiments of the present invention will now be described with reference to the accompanying drawings in order to explain the present invention in more detail.

First Embodiment

Figure 1:
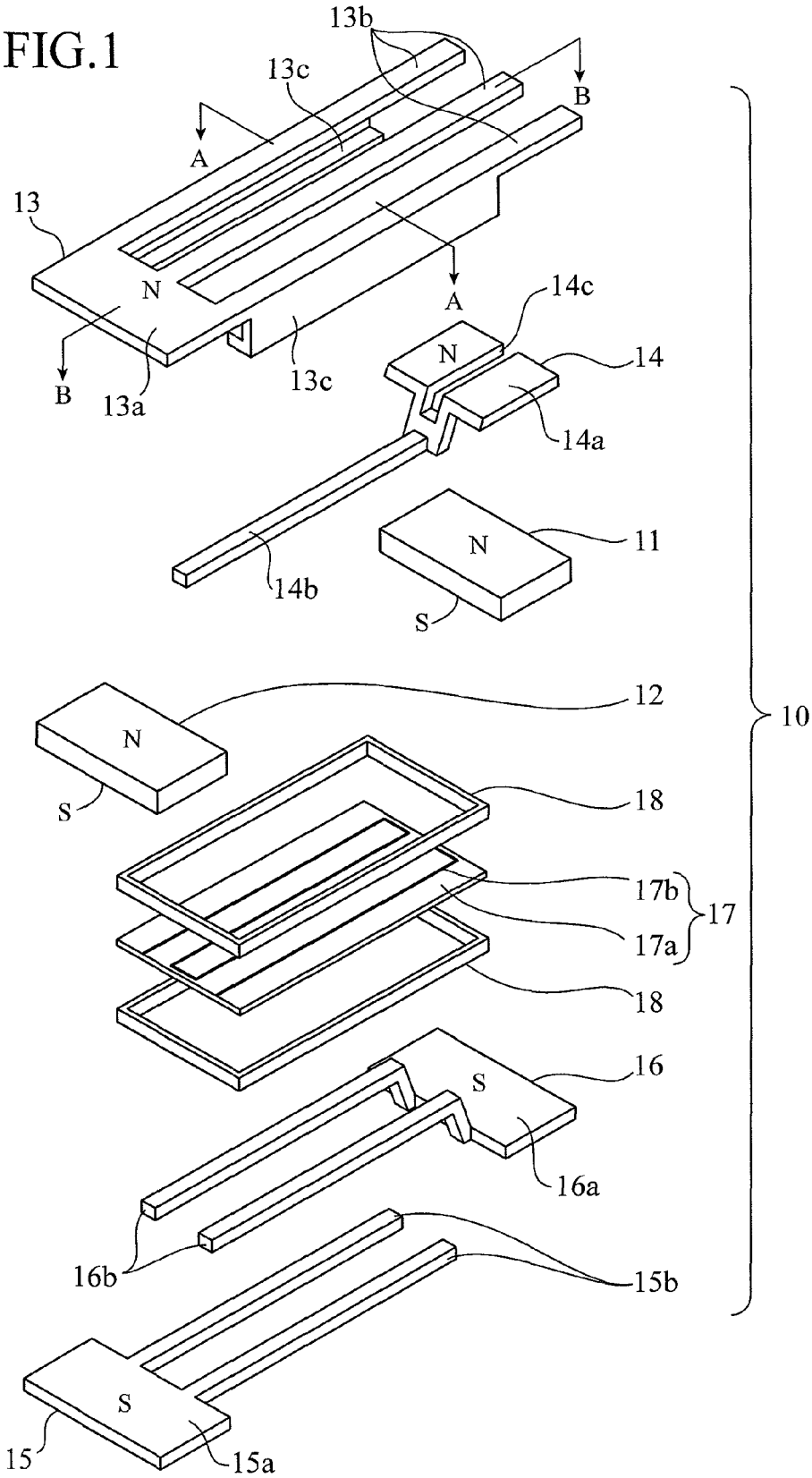
FIG. 1 is an exploded perspective view showing the arrangement of an electromagnetic conversion unit in accordance with a first embodiment of the present invention.
Figure 2:
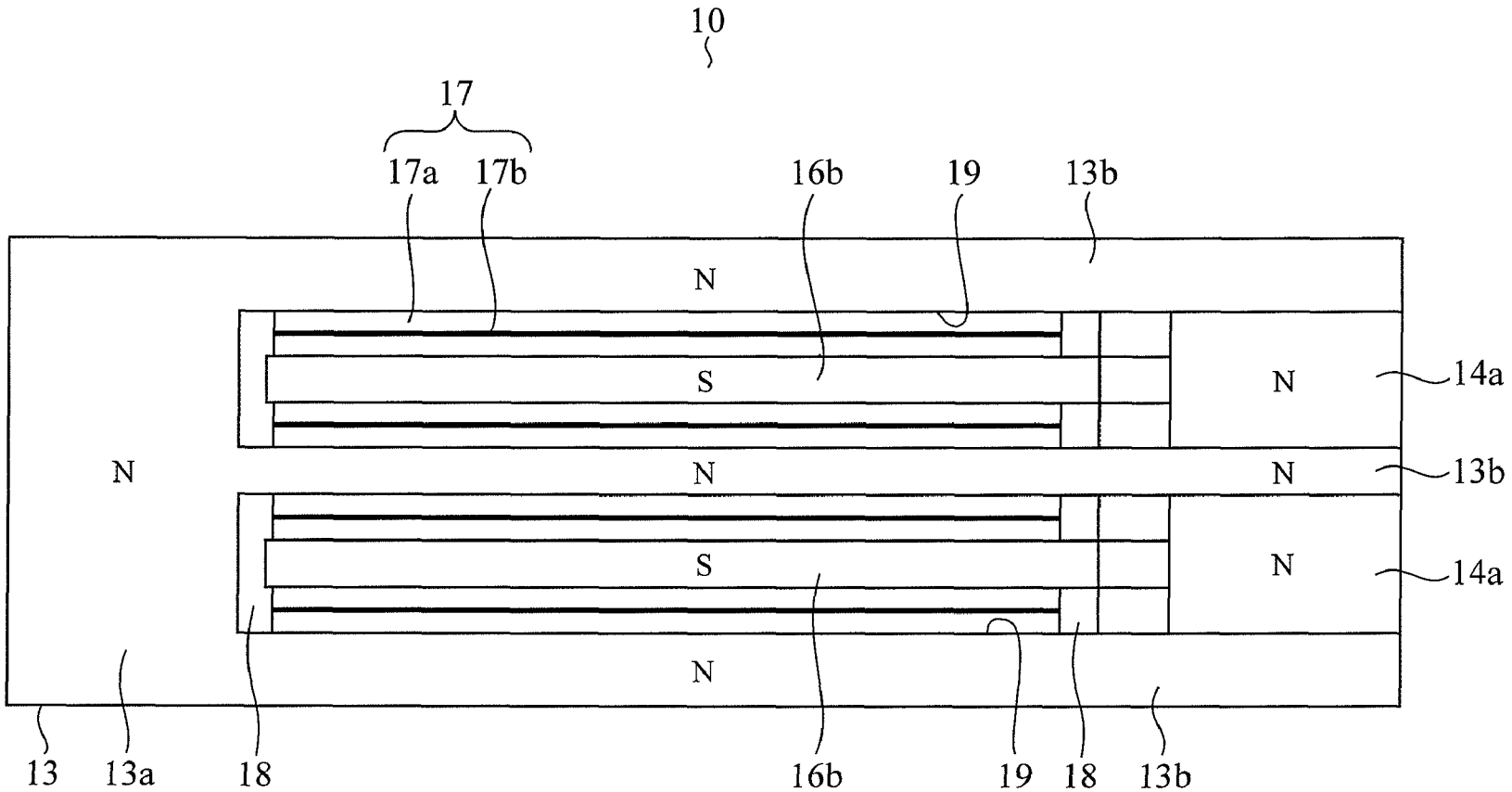
FIG. 2 is a top view showing the arrangement of the electromagnetic conversion unit in accordance with the first embodiment of the present invention.
Figure 3:
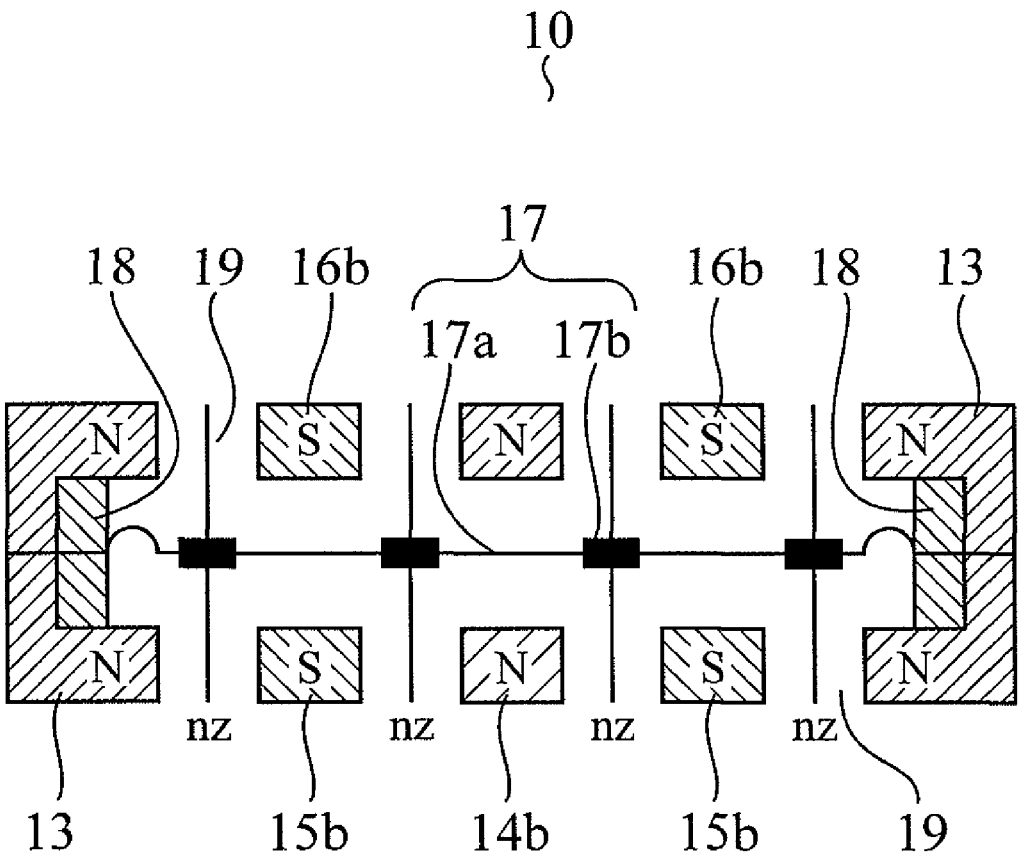
FIG. 3 is a cross sectional view along the line A-A of FIG. 1.
Figure 4:
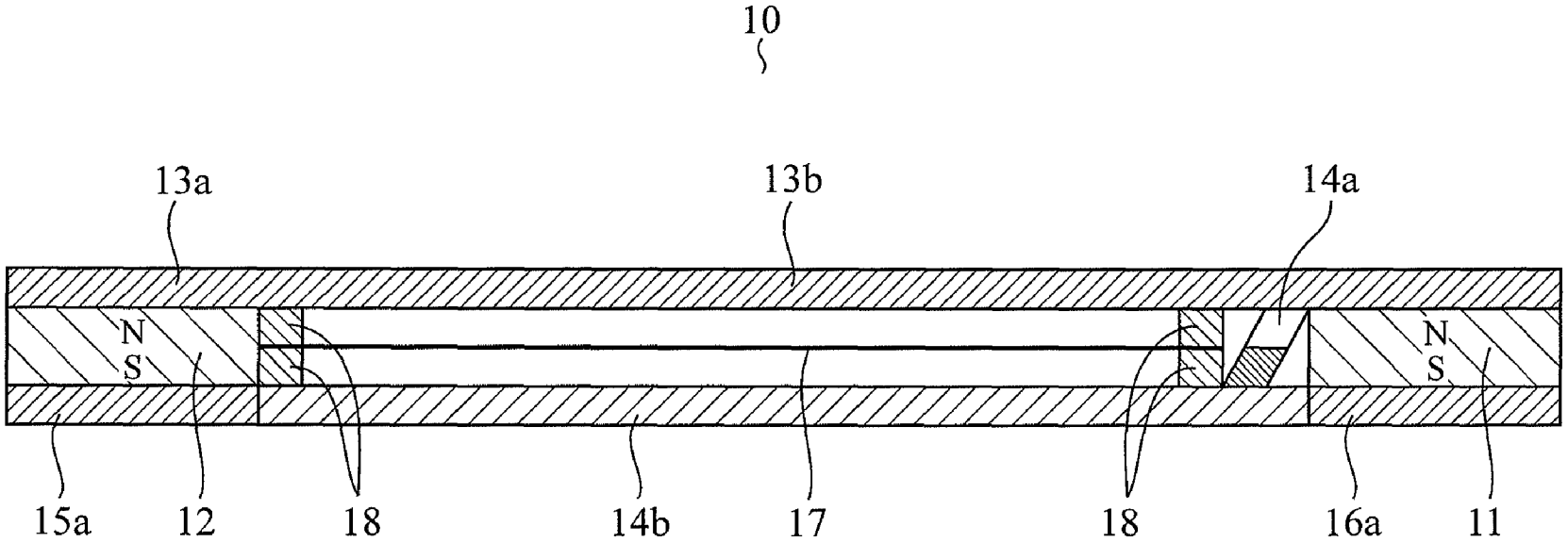
FIG. 4 is a cross sectional view along the line B-B of FIG. 1.

The arrangement of an electromagnetic conversion unit in accordance with a first embodiment of the present invention will be discussed with reference to FIG. 1 to FIG. 4. FIG. 1 is an exploded perspective view showing the arrangement of an electromagnetic conversion unit in accordance with the first embodiment of the present invention. FIG. 2 is a top view showing the arrangement of the electromagnetic conversion unit in accordance with the first embodiment of the present invention. Further, FIG. 3 is a sectional view along the line A-A of FIG. 1, and FIG. 4 is a sectional view along the line B-B of FIG. 1.

An electromagnetic conversion unit 10 is composed of two magnets 11, 12, a first magnetic pole yoke 13, a second magnetic pole yoke 14, a third magnetic pole yoke 15, a fourth magnetic pole yoke 16, a vibrating membrane 17, a gasket (fixing member) 18, and a sound emitting hole 19.

The magnet 11 and the magnet 12 are disposed at the two outer ends on the short sides of the rectangular vibrating membrane 17, and each have magnetic poles established vertically with respect to the plane on which the vibrating membrane 17 is formed. In the first embodiment, as shown in FIG. 1, the magnet 11 and the magnet 12 are arranged to have an N pole on the top face thereof and have an S pole on the bottom face thereof. The magnet 11 and the magnet 12 are disposed to be sandwiched between the first magnetic pole yoke 13 and the second magnetic pole yoke 14 from above and the third magnetic pole yoke 15 and the fourth magnetic pole yoke 16 from below. The magnetic pole yokes 13-16 consist of a material having a high permeability such as iron.

The first magnetic pole yoke 13 is composed of an abutting section 13*a* abutting against the N pole on the top face of the magnet 12, three magnetic pole sections 13*b* extending in a band or strip shape at a predetermined spacing from the abutting section 13*a*, and enclosing sections 13*c* extending in a substantially L shape downwardly from the two external magnetic pole sections 13*b*, respectively. Those three magnetic pole sections 13*b* are located above the vibrating membrane 17 when the electromagnetic conversion unit 10 is assembled. The second magnetic pole yoke 14 consists of an abutting section 14*a* abutting against the N pole on the top face of the magnet 11 and a magnetic pole section 14*b* extending in a strip shape from the abutting section 14*a*. The magnetic pole section 14*b* intersects the magnetic pole sections of the fourth magnetic pole yoke 16 described later, and is located under the vibrating membrane 17 when the electromagnetic conversion unit 10 is assembled. Further, a concavity 14*c* in which the central portion of the magnetic pole section 13*b* can fit is formed on the top face of the abutting section 14*a*.

The third magnetic pole yoke 15 is composed of an abutting section 15*a* abutting against the S pole on the bottom face of the magnet 12 and two magnetic pole sections 15*b* extending in a strip shape at a predetermined spacing from the abutting section 15*a*. The two magnetic pole sections 15*b* are located under the vibrating membrane 17 when the electromagnetic conversion unit 10 is assembled. The fourth magnetic pole yoke 16 is composed of an abutting section 16*a* abutting against the S pole on the bottom face of the magnet 11 and magnetic pole sections 16*b* extending in a strip shape at a predetermined spacing from the abutting section 16*a*. The magnetic pole sections 16*b* are formed in a bending manner so as to intersect the magnetic pole section 14*b* of the second magnetic pole yoke 14 to be located under the vibrating membrane 17 when the electromagnetic conversion unit 10 is assembled.

The first magnetic pole yoke 13 and the second magnetic pole yoke 14 that abut respectively against the N poles of the magnet 11 and the magnet 12 are magnetized as an N pole, and the third magnetic pole yoke 15 and the fourth magnetic pole yoke 16 that abut respectively against the S poles of the magnet 11 and the magnet 12 are magnetized as an S pole. Further, the magnetic pole section 14*b* of the second magnetic pole yoke 14 and the magnetic pole sections 16*b* of the fourth magnetic pole yoke 16 are disposed to intersect with each other vertically. Thus, when the magnetic pole yokes 13-16 are assembled, the magnetic pole sections 13*b* magnetized as the N pole are spaced alternately with the magnetic pole sections 16*b* magnetized as the S pole as shown in FIG. 2 and FIG. 3 to form a magnetic pole face on the upper side of the vibrating membrane 17, and the magnetic pole section 14*b* magnetized as the N pole is spaced alternately with the magnetic pole sections 15*b* magnetized as the S pole to form a magnetic pole face on the lower side of the vibrating membrane 17.

The vibrating membrane 17 is formed of a rectangular thin and flexible resin film 17*a*, and a meandering coil pattern 17*b* with a meandering conductor pattern is formed on both sides of the membrane. The vibrating membrane 17 is disposed opposite to the magnetic pole faces formed by the magnetic pole yokes 13-16. As shown in FIG. 3, the meandering coil pattern 17*b* is located on a neutral zone nz in the gap formed between the magnetic pole sections 13*b*-16*b* magnetized as the N pole or the S pole when the magnetic pole yokes 13-16 are assembled.

A gasket 18 is formed of a resin, non-magnetic metal, or the like, and two gaskets hold the outer peripheral portion of the vibrating membrane 17 therebetween. When the electromagnetic conversion unit 10 is assembled, the gaskets 18 are held further between the magnetic pole yokes 13-16, and thereby the vibrating membrane 17 is positioned. In this context, the magnetic pole yokes 13-16 holding therebetween the vibrating membrane 17 and the gaskets 18 also function as a frame.

The sound emitting holes 19 are formed by the gaps formed between the magnetic pole sections 13*b*, 16*b*, and the gaps formed between the magnetic pole sections 14*b*, 15*b*, when the magnetic pole yokes 13-16 are assembled. It is noted that when the vibrating membrane 17 is held between the gaskets 18 and the magnetic pole yokes 13-16, it is arranged that as shown to FIG. 2, the vibrating membrane is held therebetween such that the lengthwise extending straight line portions of the meandering coil pattern 17*b* of the vibrating membrane 17 are located at the positions where the sound emitting holes 19 are formed. Here, the "straight line portions" means the long straight line portions disposed parallel to each other at a predetermined spacing in the meandering coil pattern 17*b*.

Next, the operation of the electromagnetic conversion unit 10 will be described.

When the meandering coil pattern 17*b* of the vibrating membrane 17 receives a current that is an audio signal flowing therethrough, the meandering coil pattern 17*b* is electromagnetically coupled to the magnetic poles of the first magnetic pole yoke 13, the second magnetic pole yoke 14, the third magnetic pole yoke 15, and the fourth magnetic pole yoke 16, and thereby the vibrating membrane 17 is vibrated in the direction of thickness according to Fleming's rule. The sound wave generated by the vibration is emitted through the sound emitting holes 19 to reproduce audio data.

As discussed above, in accordance with the first embodiment, the two magnets are arranged to be disposed at the outer two ends of the vibrating membrane. Thus, it becomes possible to change the magnet in size and thickness, and even use of an inexpensive magnet having a relatively low maximum energy product such as a ferrite magnet can provide a magnetic flux density required for driving the vibrating membrane.

Furthermore, in accordance with the first embodiment, it is arranged that the magnetic pole sections of the magnetic pole yokes are disposed alternately to provide the gaps between the magnetic pole sections as the sound emitting holes. Thus, the magnetic pole yokes can be also used as frames without newly providing a frame having a sound emitting hole formed in itself, and thereby reduced cost of an electromagnetic conversion unit can be achieved.

Further, in accordance with the first embodiment, it is arranged that the gaskets for positioning the vibrating membrane are provided and the gaskets are held between the magnetic pole yokes in a nesting or pinching relation therewith. Thus, the magnetic pole yokes can be used also as a frame for fixing the vibrating membrane, and the cost of an electromagnetic conversion unit can be reduced.

It should be noted that in the first embodiment discussed above, an arrangement using two magnets 11, 12 is shown; however, the number of the magnets is not limited to the number as long as the arrangement magnetizes the magnetic pole yokes.

Further, in the first embodiment discussed above, an arrangement is shown in which the magnetic pole yoke 13 has three magnetic pole sections 13*b*, the magnetic pole yoke 14 has one magnetic pole section 14*b*, and the magnetic pole yoke 15 and the magnetic pole yoke 16 have two magnetic pole sections 15*b* and 16*b*, respectively; however, the numbers of the magnetic pole sections are not limited to the above-mentioned numbers, and the numbers of the magnetic pole sections thereof can be properly changed as long as the magnetic yokes can form a magnetic pole face where magnetic pole sections magnetized as an N pole and magnetic pole sections magnetized as an S pole are disposed alternately.

Moreover, in accordance with the first embodiment, an arrangement is shown in which the magnetic pole section 14*b* of the magnetic pole yoke 14 and the magnetic pole sections 16*b* of the magnetic pole yoke 16 intersect with each other; however, an arrangement is not limited to the arrangement as long as a magnetic pole face can be formed in which magnetic pole sections magnetized as an N pole and magnetic pole sections magnetized as an S pole are disposed alternately.

INDUSTRIAL APPLICABILITY

As discussed above, the electromagnetic conversion unit according to the present invention can provide a required magnetic flux density using a magnet having a relatively low maximum energy product (BHmax) such as a ferrite magnet or the equivalent, and thus the electromagnetic conversion unit is suitable for audio systems for reproducing audio signals.

The invention claimed is:

1. An electromagnetic conversion unit includes:

at least two magnets each having both poles on the opposite faces thereof;

a plurality of magnetic pole yokes that are each magnetized by one of the at least two magnets to establish a magnetic pole; and a vibrating membrane that is disposed between the at least two magnets and is electromagnetically coupled to the magnetic pole yokes by energizing a coil pattern formed on the surface of the membrane to vibrate in a predetermined direction, wherein the magnetic pole yokes each include an abutting section that abuts against one of the at least two magnets to be magnetized and a magnetic pole section for establishing the magnetic pole in a band shape, and wherein a plurality of magnetic pole sections of the plural magnetic pole yokes are disposed on the upper and lower sides of the vibrating membrane, and also the magnetic pole sections are disposed at a spacing such that the magnetic pole sections different from each other in magnetic polarity are positioned alternately in a lateral direction of the vibrating membrane to form magnetic pole faces on the upper and lower sides of the vibrating membrane.

2. The electromagnetic conversion unit according to claim 1, wherein a gap formed between the magnetic pole sections in the lateral direction of the vibrating membrane provides a sound emitting hole.

3. The electromagnetic conversion unit according to claim 1, wherein the plurality of magnetic pole yokes enclose and fix the vibrating membrane therein.

4. The electromagnetic conversion unit according to claim 1, wherein a fixing member for fixing the vibrating membrane therein by holding the outer peripheral portion of the membrane therebetween is provided, and the plurality of magnetic pole yokes hold the vibrating membrane and the fixing member therebetween to enclose the vibrating membrane and the fixing member.

* * * * *